United States Patent [19]

Glen

[11] Patent Number: 5,052,937

[45] Date of Patent: Oct. 1, 1991

[54] BASEBOARD WITH MOVABLE ELECTRICAL OUTLET

[76] Inventor: Bryan D. Glen, 1846 W. 14th Ave., Vancouver, B.C., Canada, V6J 2J9

[21] Appl. No.: 499,703

[22] Filed: Mar. 27, 1990

[51] Int. Cl.[5] ..... H01R 25/14

[52] U.S. Cl. ..... 439/120; 439/211

[58] Field of Search ..... 439/110-122, 439/207, 209-211, 214, 213, 216, 332-334, 361, 359

[56] References Cited

U.S. PATENT DOCUMENTS

| | | | |
|---|---|---|---|
| 1,812,956 | 7/1931 | Howk | 174/49 |
| 2,042,105 | 5/1936 | Kelley | 439/113 |
| 2,076,558 | 4/1937 | Hartman et al. | 439/120 |
| 2,279,383 | 4/1942 | Von Gehr | 439/120 |
| 2,319,375 | 5/1943 | Von Gehr | 439/120 |
| 2,617,849 | 11/1952 | Wright et al. | 439/120 |
| 2,669,632 | 2/1954 | Hammerly | 439/114 |
| 3,089,042 | 5/1963 | Hickey et al. | 439/110 |
| 3,603,918 | 9/1971 | Woertz | 439/115 |
| 4,190,309 | 2/1980 | Glass | 439/118 |
| 4,479,687 | 10/1984 | Humphreys et al. | 439/120 |
| 4,690,474 | 9/1987 | Smart et al. | 439/120 |

FOREIGN PATENT DOCUMENTS

| | | | |
|---|---|---|---|
| 2423898 | 12/1979 | France | 439/114 |
| 51295 | 6/1966 | Poland | 439/110 |
| 839347 | 6/1960 | United Kingdom | 439/110 |

*Primary Examiner*—Gary F. Paumen
*Attorney, Agent, or Firm*—Barrigar & Oyen

[57] ABSTRACT

Existing electrical outlet tracks require that the outlet be slid from one location to another along the track. The present invention provides a readily movable electrical receptacle which also discourages contact with the conductors. The receptacles of the present invention can be readily installed at any location along a baseboard conductor without sliding of the receptacle. This is accomplished using a T-shaped element which is inserted through the lengthwise groove of the continuous track and rotated into place. Screw-mounted bars are used to tighten the receptacle into place at the chosen location.

14 Claims, 8 Drawing Sheets

BASEBOARD WITH MOVABLE ELECTRICAL OUTLET

BACKGROUND OF THE INVENTION

The invention relates to the field of continuous electrical distribution systems whereby an electrical outlet can be positioned at any one of a number of locations along a wall.

In conventional residential and commercial construction, outlets for electricity and telephone lines are installed in the walls of a room at fixed, spaced locations around the room. When changes are made in the location of the apparatus using these outlets, it is often necessary to change the location of the outlet, which involves installing a new outlet in the wall, repairing the drywall and repainting at the previous location. This is particularly time-consuming and expensive in the commercial office situation where moves are relatively frequent.

Various systems have been designed to provide a conductive track along which a receptacle may be moved. One of the primary considerations in such a design is that the conductive elements must be guarded against accidental contact by a child or user. For example, U.S. Pat. No. 1,812,956 issued July 7, 1931 to Howk discloses an electrical outlet comprising an elongated housing having a lengthwise slot and a conductor extending along the length of the housing. An electrical receptacle rides along the slot by means of rollers which contact the conductor. The receptacle is not provided with a ground connection as is required in modern electrical systems, and in order to change the position of the receptacle it is necessary to roll it completely around the track from one location to the other. This may cause unnecessary complications where there are a number of receptacles along a track and only one needs to be moved to another location. Further, apparently the Howk receptacle cannot be rigidly secured at the selected location.

Another movable electrical receptacle is disclosed in Kelley U.S. Pat. No. 2,042,105 issued May 26, 1936. Here various means are used to guard the conductors, including a zipper arrangement, a pair of overlapping ribbons and a recessed rib. The same disadvantage noted for the Howk design also apply to these designs.

Other electrical systems permitting the movement of receptacles are shown in U.S. Pat. Nos. 2,076,558; 2,279,383; 2,319,375; 2,617,849: 2,669,632: 3,089,042. These various designs all require the sliding of the receptacle along the track to reach the desired position.

U.S. Pat. No. 4,479,687 issued Oct. 30, 1984 to Electrak International Limited discloses an electrical distribution system in which a specially designed plug may be inserted in any one of a number of apertures along a continuous conductor. However it does not allow for the use of conventional plugs U.S. Pat. No. 4,690,474 issued Sept. 1, 1987 discloses a safety wall plug in which the plug is slid from the peripheral edge of the wall outlet to the inner edge of a passage in the wall outlet. It does not permit the movement of the position of the electrical outlet.

There is therefore a need for a continuous electrical distribution system which allows a receptacle to be installed at any location along a track, without requiring that the receptacle be slid from one location to another along the track, and without exposing the conductors to the possibility of contact by a user.

SUMMARY OF THE INVENTION

The present invention provides an electrical distribution system comprising: an elongated housing having a front panel defining a hollow interior, and an elongated slot formed in said front panel, said front panel having an inner and outer surface; first and second electrical conduction means fixed to the inner surface of said front panel, each said conduction means being parallel to and spaced from said slot; and movable receptacle means for releasably engaging said housing comprising a front face having electrical plug receptacle means, means for releasably securing said movable receptacle to said housing and means for engaging said conduction means, said conduction engaging means comprising an elongated bar having a width less than said slot and conductive elements fixed to said inner surface of said bar and connected to said electrical receptacle means, said conduction engaging means being adapted to engage said conduction means when said receptacle means is installed in said slot.

BRIEF DESCRIPTION OF THE DRAWINGS

In drawings which illustrate a preferred embodiment of the invention.

DETAILED DESCRIPTION OF A PREFERRED EMBODIMENT

Figure 1:
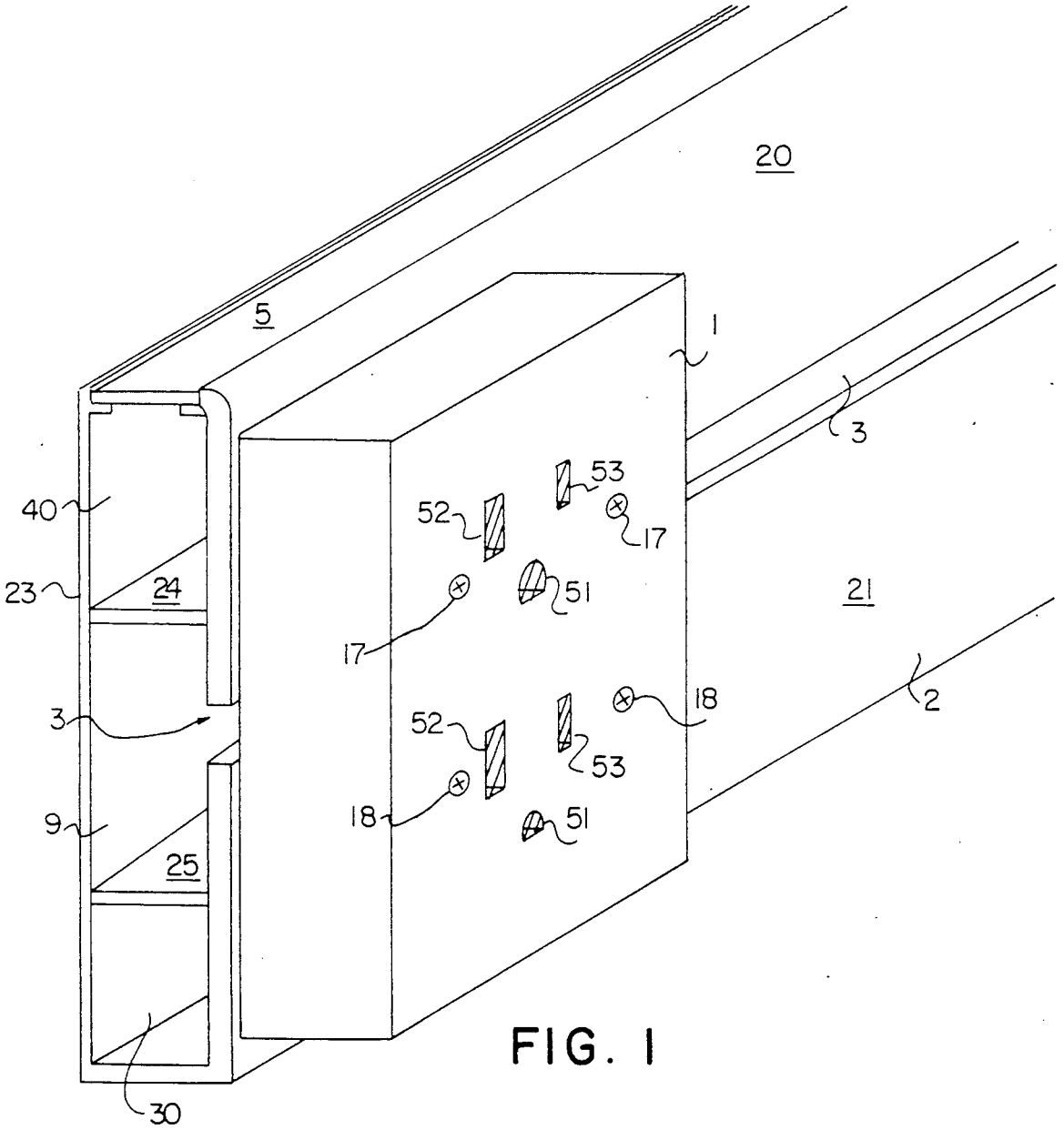
FIG. 1 is a perspective view of the invention.

With reference to FIG. 1, the movable electrical receptacle is designated as 1 and the supporting baseboard structure as 2. Baseboard 2 has an elongated slot 3 in which receptacle 1 seats. Baseboard 2 is constructed to resemble a standard wooden baseboard but in fact is constructed of moulded plastic, bakelite or similar material. It is constructed of a back panel 23, front panels 20 and 21 and horizontal dividers 24 and 25 which separate the hollow interior into compartments 40, 9 and 30 which extend along the length of the baseboard. Compartment 40 serves to hold cables such as telephone, cable television and computer network cables. Compartment 40 is accessible by a removable strip 5.

Figure 2:
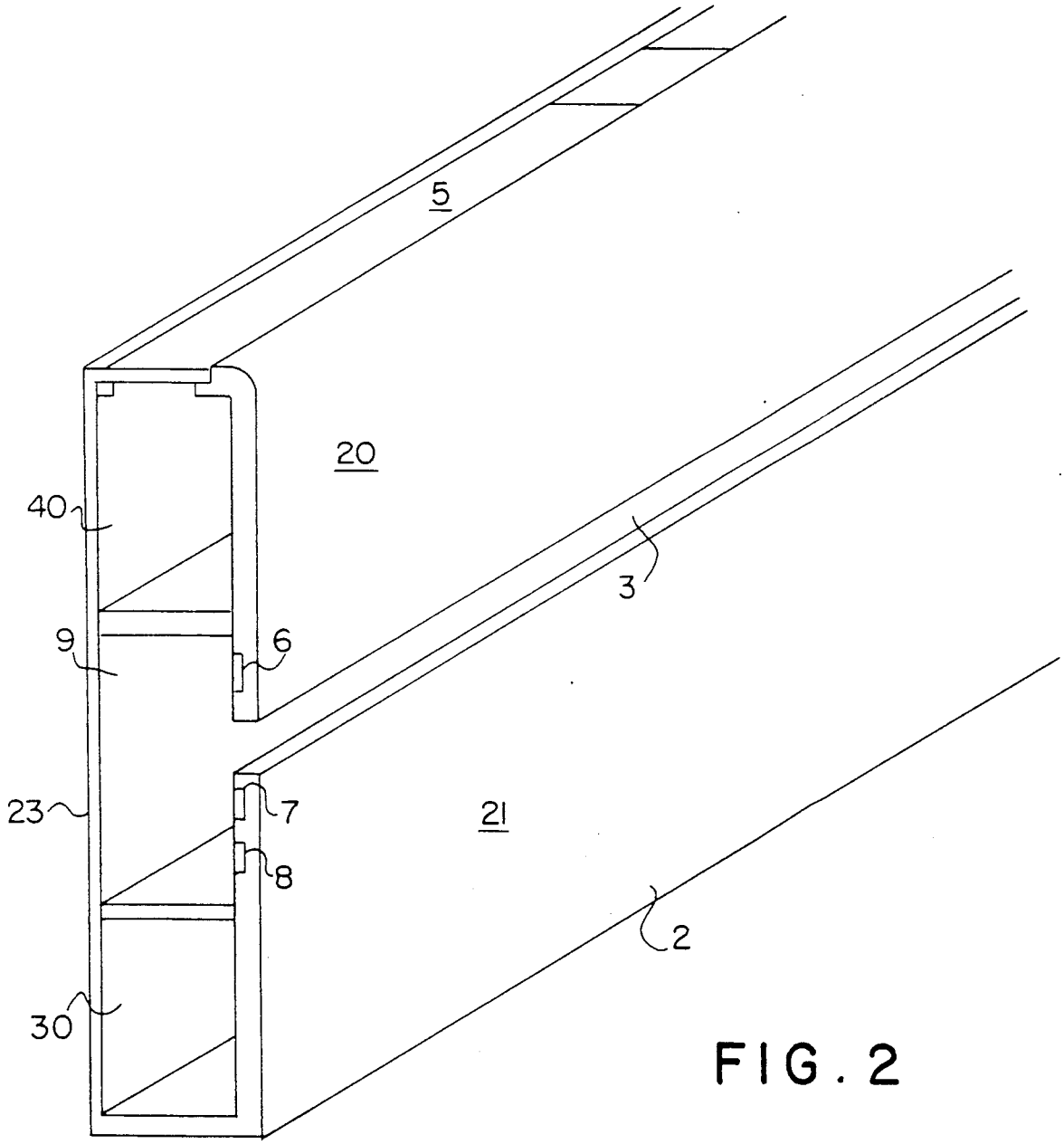
FIG. 2 is a perspective view of the invention as shown in FIG. 1 with the receptacle removed.

As further illustrated in FIG. 2, conductors 6, 7 and 8 are fixed along the inner surface of compartment 9. Conductor 6 preferably carries a positive potential, while conductor 7 is the negative terminal and conductor 8 is grounded. In this way polarized plugs may be used to reduce the possibility of a child accidentally being electrocuted. Slot 3 is preferably about ⅜" wide.

Figure 3:
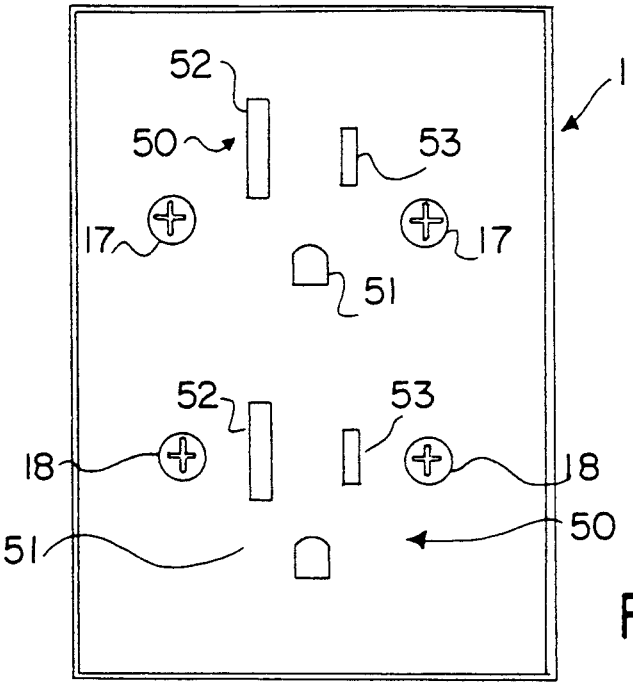
FIG. 3 is a front view of the receptacle shown in FIG. 1.

FIG. 3 illustrates the receptacle in front view, having two polarized plug receptacles 50, consisting of ground receptacle 51, negative receptacle 52 and positive receptacle 53, and four tightening screws 17 and 18.

Figure 4:
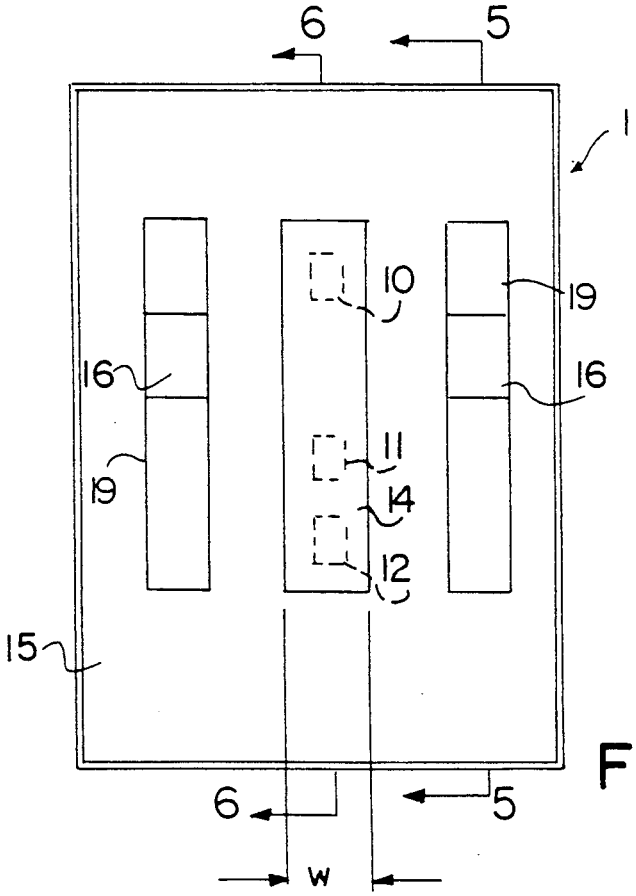
FIG. 4 is a rear view taken of the receptacle shown in FIG. 1.
Figure 5:
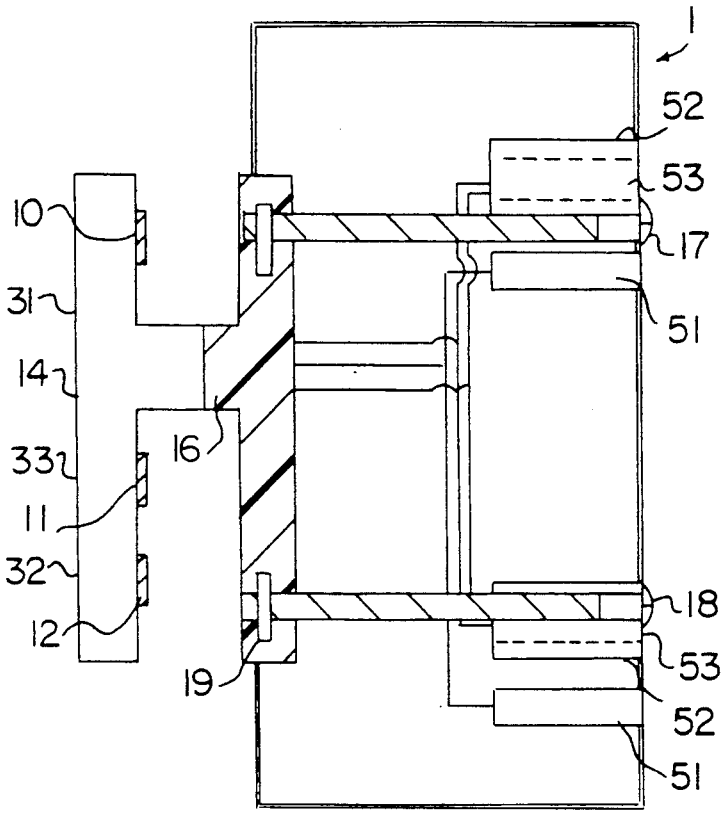
FIG. 5 is a cross-sectional view of the invention shown in FIG. 1 taken along lines 5—5 of FIG. 4.
Figure 6:
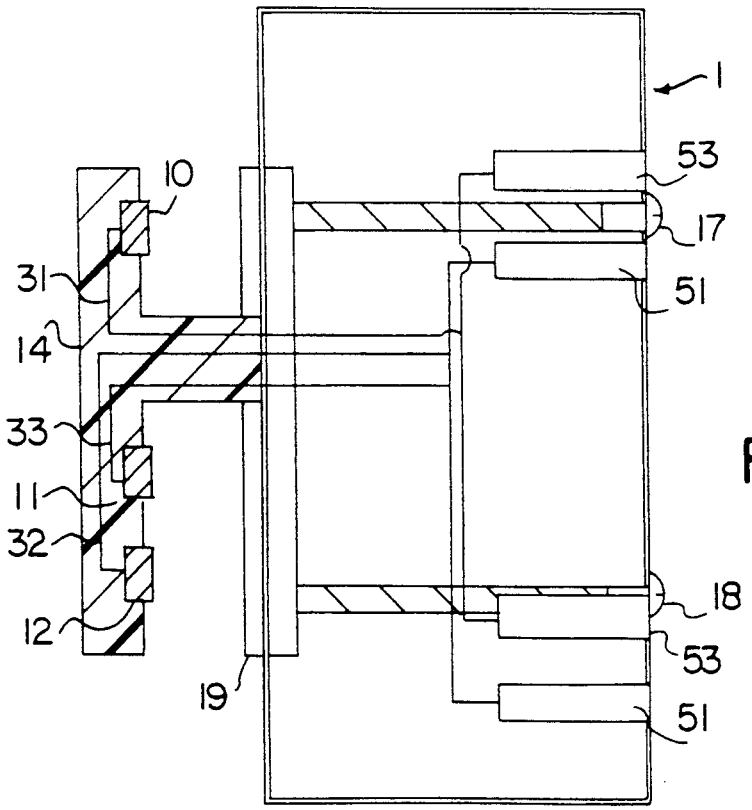
FIG. 6 is a cross-sectional view of the invention shown in FIG. 1 taken along lines 6—6 of FIG. 4.

As shown in FIGS. 5 and 6, the conductive contacts 10, 11 and 12 are carried on rigid T-shaped assembly 14, and are connected to the plug receptacle via conductors 31, 32 and 33. The dimensions of assembly 14 are chosen so that width w, shown in FIG. 4, is less than the width of slot 3, so that assembly 14 can be inserted through slot 3 and rotated by turning receptacle 1. When rotated through 90 degrees, contacts 10, 11 and 12 then come into firm sliding contact with conductors 6, 7 and 8. The height of the lower part of the T, carrying contacts 11 and 12, is greater than the height of the upper part of the T carrying contact 10. Since similarly the height of the portion of compartment 9 below groove 3 is greater than the height of the portion of compartment 9 above the groove 3, the T-shaped element can only be rotated in such a way that the three conductors are properly aligned with the respective contact.

Once receptacle 1 has been inserted into slot 3 as noted, and rotated to bring the conductors into contact, the receptacle is tightened into place by tightening screws 17 and 18. Bars 19 are threaded to move on screws 17 and 18 as they are rotated and in this way bars 19 are pressed against faces 20 and 21 when the receptacle is in position. Tenon or protrusion 16 is sized to fit snugly in slot 3 when the bar 19 is extended in order to secure the receptacle firmly in position and keep it from wobbling.

To change the position of the receptacle, the screws 17 and 18 are loosened, drawing bars 19 away from baseboard 2 and drawing tenon 16 out of slot 3. The receptacle 1 is then rotated 90 degrees to permit assembly 14 to be withdrawn from slot 3. The receptacle can then be moved to another location on the baseboard.

Figure 7:
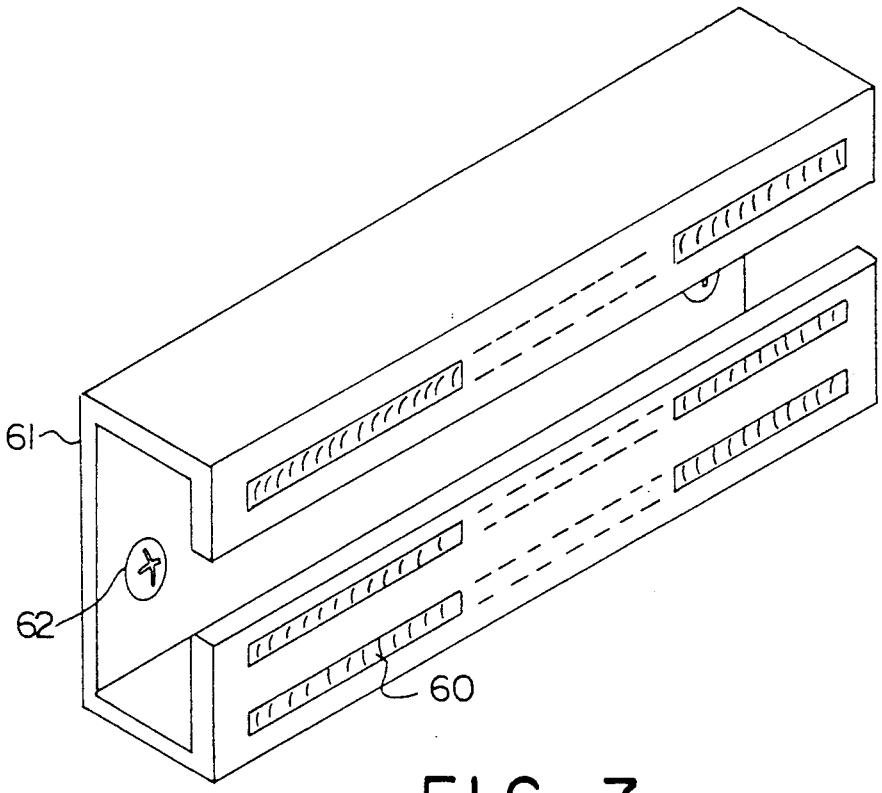
FIG. 7 is a perspective view of a connector piece for connecting the baseboard tracks of the invention.

FIG. 7 illustrates a piece to connect two lengths of the baseboard 2. One end of body 61 slides inside the open end of compartment 9 of one baseboard unit, while the other end of body 61 slides into the similar compartment 9 of the second baseboard unit. The body 61 is secured to each respective baseboard unit 2 using screws 62. Spring type conduction connectors 60 make contact with conductors 6, 7 and 8 of each unit, completing the connection between the corresponding conductor of each unit. The connectors 60 are continuous from one end of the body 61 to the other, but are only exposed at either end to make contact with the conductors in the baseboard units.

Figure 8:
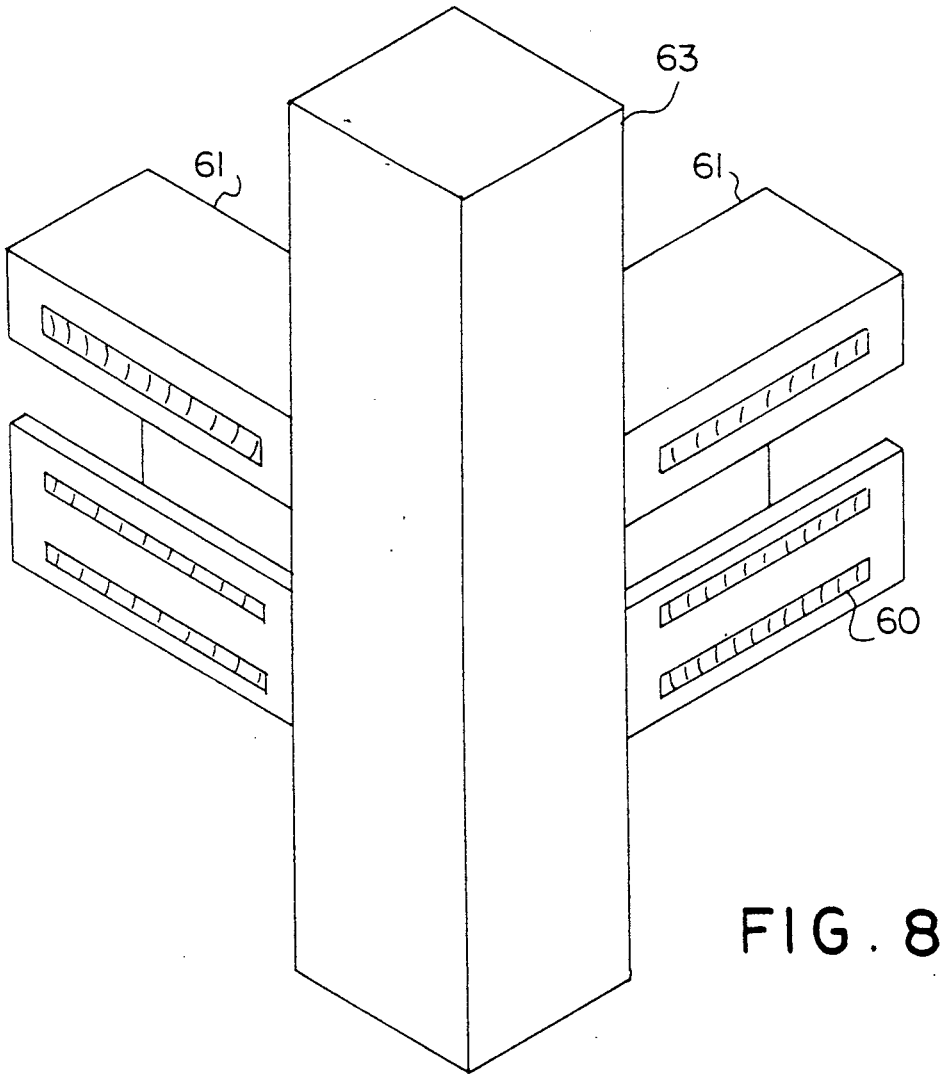
FIG. 8 is a perspective view of a connector piece for connecting the baseboard tracks of the invention at an outside corner.
Figure 9:
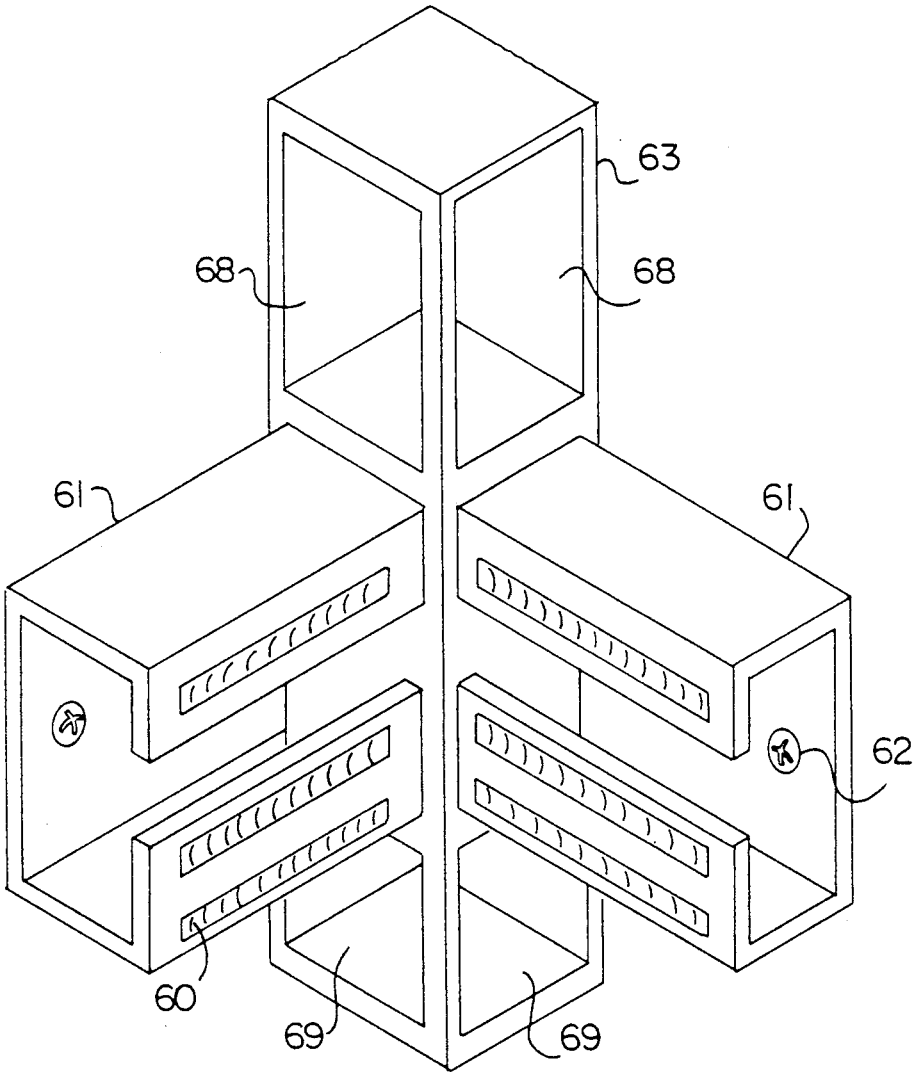
FIG. 9 is a perspective view of a connector piece for connecting the baseboard tracks of the invention at an inside corner.

FIGS. 8 and 9 similarly illustrate connector pieces which allow the baseboard tracks of the invention to span a corner, either with the track on the outside of the corner (FIG. 8) or the inside (FIG. 9). A corner post 63 supports two body units 61 at right angles. Each body unit 61 is constructed as in FIG. 7 to fit into compartment 9 of the respective baeboard units 2, to be secured using screws 62. Connectors 60 contact conductors 6, 7 and 8 to connect them to the corresponding conductor of the other baseboard unit. Apertures 68 and 69 permit continuation of compartments 40 and 30 respectively around the corner.

Figure 10:
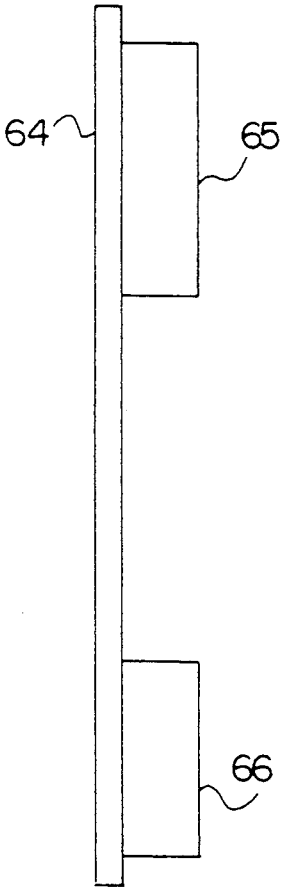
FIG. 10 is a side view of an end cap for the baseboard track units of the invention.

FIG. 10 illustrates an end cap 64 for use to close the ends of a baseboard unit 2 and prevent access to the conductors. It has two rectangular projections 65 and 66 which are inserted in a friction fit into the ends of compartments 30 and 40, and can be glued in place for added security.

Figure 11:
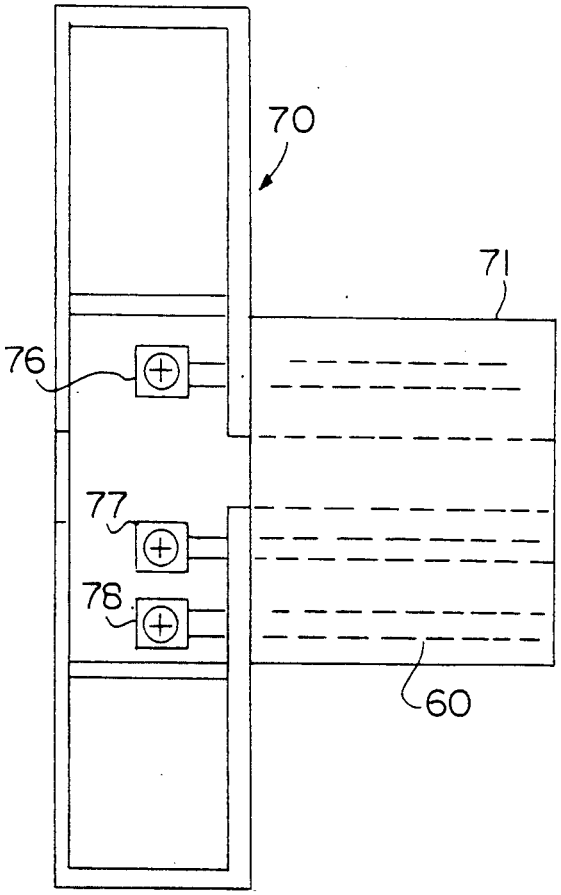
FIG. 11 is a rear view of a power connection end cap for the baseboard track units of the invention.

FIG. 11 illustrates an end cap 70 for power connection. Extension 71 slides into the open end of compartment 9 of the baseboard unit 2 of interest. Connectors 60 make contact with the conductors 6, 7 and 8, and the ends of these conductors are connected to terminals 76, 77 and 78 for connection of an electrical power source to power the baseboard track units of the invention.

While the invention has been described using conductors to carry electrical power, similar construction could be used for the telephone circuit. The coaxial cables are carried in compartment 40.

As will be apparent to those skilled in the art, various modifications and adaptations of the structure above described may be made without departing from the spirit of the invention, the scope of which is to be construed in accordance with the accompanying claims. For example, while the invention has been described in the context of a unit resembling a baseboard, the same principles could be applied to a vertical track on a wall, a track mounted directly to the floor, or a ceiling-mounted track.

The embodiments of the invention in which an exclusive property or privilege is claimed are defined as follows:

1. An electrical distribution system comprising:

a) an elongated housing having a front panel defining a hollow interior, and an elongated slot formed in said front panel, said front panel having an inner and outer surface;

b) first and second electrical conduction means fixed to the inner surface of said front panel, each said conduction means being parallel to and spaced from said slot;

c) means for providing an electrical differential between said first and second conduction means; and d) movable receptacle means for releasably engaging said housing comprising a front face having electrical plug receptacle means, means for releasably securing said movable receptacle to said housing and means for engaging said conduction means, said conduction engaging means comprising an elongated bar having a width less than said slot and conductive elements fixed to an inner surface of said bar and connected to said electrical receptacle means, said conduction engaging means being adapted to engage said conduction means when said receptable means is installed in said slot, and said means for securing is movable from a first withdrawn position to a second slot-engaging position;

wherein said means for securing comprises two second elongated bars spaced to either side of said conductor engaging means, each said second elongated bar being threadably movable on a screw and provided with tenon means for mating with said slot.

2. The electrical distribution system of claim 1 wherein said first and second electrical conduction means are fixed at respective locations above and below said slot.

3. The electrical distribution system of claim 1 wherein said conduction means comprises positive, negative and ground conductors.

4. The electrical distribution system of claim 1 wherein said conduction-engaging means is T-shaped.

5. The electrical distribution system of claim 3 wherein said conduction-engaging means is T-shaped, and one side of the top of the T is longer than the other side.

6. The electrical distribution system of claim 1 wherein said housing further comprises divider means forming separate lengthwise compartments in said housing for receiving cables.

7. The electrical distribution system of claim 1 wherein said means for providing an electrical differential comprises a body having a projection adapted to be mounted in an end of said hollow interior and provided with first and second conductors located to contact said first and second conduction means on said front panel, and terminal means connected to said first and second conductors for connection to a source of electrical power.

8. The electrical distribution system of claim 1 further comprising connector means having first and second ends, each end having a projection adapted to be fixedly mounted in an end of said hollow interior and provided with first and second conductors located to contact said first and second conduction means on said front panel, whereby an electrical connection is made between the conduction means of first and second housings when said first and second ends of said connector means are mounted in said first and second housings.

9. The electrical distribution system of claim 8 wherein said connector means comprises a central vertical post and said first and second ends meet said post at right angles.

10. The electrical distribution system of claim 6 further comprising connector means having first and second ends, each end having a projection adapted to be fixedly mounted in an end of said hollow interior and provided with first and second conductors located to contact said first and second conduction means on said front panel, whereby an electrical connection is made between the conduction means of first and second housings when said first and second ends of said connector means are mounted in said first and second housings.

11. The electrical distribution system of claim 10 wherein said connector means comprises a central vertical post and said first and second ends meet said post at right angles.

12. The electrical distribution system of claim 11 wherein said central post is provided with apertures adapted to communicate with said lengthwise cable compartments.

13. The electrical distribution system of claim 1 wherein said means for securing further comprises a surface adapted for bearing against said outer surface of said front panel when said means for securing is in said slot-engaging position.

14. The electrical distribution system of claim 6 wherein said housing further comprises a removable strip for providing access to one of said cable compartments.

* * * * *